United States Patent [19]

Kido et al.

[11] 4,291,119

[45] Sep. 22, 1981

[54] RECORDING MATERIAL

[75] Inventors: Keishiro Kido; Satoshi Yoshida; Tomoaki Ikeda, all of Asaka, Japan

[73] Assignee: Fuji Photo Film Co., Ltd., Kanagawa, Japan

[21] Appl. No.: 114,457

[22] Filed: Jan. 23, 1980

Related U.S. Application Data

[60] Division of Ser. No. 875,066, Feb. 3, 1978, Pat. No. 4,188,214, which is a continuation of Ser. No. 695,212, Jun. 11, 1976, abandoned.

[30] Foreign Application Priority Data

Aug. 11, 1975 [JP] Japan ..... 50-97251

[51] Int. Cl.[3] ..... G03C 5/24

[52] U.S. Cl. ..... 430/348; 430/495; 430/496; 430/524; 430/525; 430/526; 346/76 L; 346/135.1

[58] Field of Search ..... 430/348, 495, 496, 525, 430/270, 524, 526; 428/525, 469, 432; 346/135.1

[56] References Cited

U.S. PATENT DOCUMENTS

| | | | |
|---|---|---|---|
| 2,750,832 | 6/1956 | Morgan | 428/469 |
| 3,202,825 | 8/1965 | Brown et al. | 428/469 |
| 3,330,681 | 7/1967 | Scharf et al. | 428/469 |
| 3,658,540 | 4/1972 | Malinowski | 430/270 |
| 3,707,372 | 12/1972 | Hallman et al. | 430/270 |
| 3,720,541 | 3/1973 | King | 428/469 |
| 3,901,997 | 8/1975 | Groth | 428/469 |
| 3,902,180 | 8/1975 | Sobajima et al. | 346/76 L |
| 3,907,566 | 9/1975 | Inoue et al. | 430/495 |
| 3,914,516 | 10/1975 | Ritter | 428/432 |
| 3,935,351 | 1/1976 | Franz | 428/469 |
| 3,978,272 | 8/1976 | Dunley | 428/469 |
| 3,996,057 | 12/1976 | Kawaziri et al. | 430/525 |
| 4,069,487 | 1/1978 | Kasau et al. | 346/76 L |
| 4,198,237 | 4/1980 | Nahara et al. | 430/495 |

FOREIGN PATENT DOCUMENTS

| | | | |
|---|---|---|---|
| 2522928 | 12/1975 | Fed. Rep. of Germany | 430/495 |

*Primary Examiner*—Won H. Louie, Jr.

*Attorney, Agent, or Firm*—Sughrue, Mion, Zinn, Macpeak & Seas

[57] ABSTRACT

A recording material comprising a support having thereon a layer containing (i) at least one metal and (ii) a layer containing one or more metal sulfides other than GeS, metal fluorides or metal oxides. A mono-layer mixture of (i) and (ii) may also be used.

11 Claims, 5 Drawing Figures

RECORDING MATERIAL

This Application is a divisional application of Ser. No. 875,066, filed Feb. 3, 1978, U.S. Pat. No. 4,188,214, in turn a Continuation application of Ser. No. 695,212, filed June 11, 1976, now abandoned.

BACKGROUND OF THE INVENTION

1. Field of the Invention

This invention relates to a recording material used for recording high energy rays.

Description of the Prior Art

As recording materials used for recording high energy rays such as a laser, there are known silver salt light-sensitive materials as well as recording materials having a recording layer composed of a substance which undergoes a thermal change such as melting or evaporation upon the application of heat energy or irradiation (e.g., see *Applied Physics*, 42, No. 11, pp. 1052–1066 (1973)). For recording on such recording materials, information is, in general, converted into electrical signals, and laser beams which are modulated corresponding to the signals are applied to the recording material to record the information thereon. This recording system has the advantages of rapid information processing and low cost of the light-sensitive materials used. Suitable recording materials used are, unlike silver salt light-sensitive materials, metals, dyes, plastics and the like which can be thermally recorded without requiring after-processing such as development. Moreover, these recording materials can immediately form an image (real time image formation) and are inexpensive. These recording materials are described, e.g., in M. L. Levene et al., *Record of 11th Symposium on Electron, Ion and Laser Beam Technology,* (1969), *Electronics*, p. 50 (Mar. 18, 1968), D. Maydan, *The Bell System Technical Journal,* 50, p. 1761 (1971), C. O. Carlson, *Science*, 154, p. 1550 (1966), etc.

However, recording on these recording materials requires a light source of high output because of their low recording sensitivity on high-speed scanning, and the devices for recording are expensive and of large size. Therefore, it has been desired to increase the recording sensitivity thereof on high-speed scanning. One method of increasing recording sensitivity is to use a recording material having a three-layer construction comprising selenium, bismuth and germanium, as described in Japanese Pat. No. 40,479/71. However, the use of selenium, bismuth and the like involves the danger of environmental pollution, and, moreover, there are many problems with the quality of the recorded image.

SUMMARY OF THE INVENTION

A first object of this invention is to provide a recording material which can be used for recording information in the form of high energy, e.g., a laser beam.

A second object of this invention is to provide a recording material of high recording sensitivity.

A third object of this invention is to provide a recording material which gives a clear reproduced image.

A fourth object of this invention is to provide a recording material free from the danger of causing environmental pollution.

The above objects are reached by using a recording material comprising a support having thereon a recording layer which undergoes a thermal change upon irradiation with high energy rays or beams (hereafter merely rays for purposes of brevity), the recording layer being composed of superimposed layers of metals and one or more compounds as described below, or a mixture of one or more of such metals and one or more of such compounds.

DETAILED DESCRIPTION OF THE INVENTION

Figure 1:
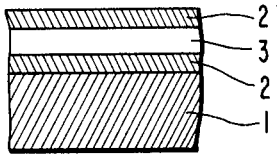
FIGS. 1 to 5 show layer constructions of recording materials of this invention.

The recording material of this invention comprises a support having thereon at least one layer containing one or more metals and at least one layer containing one or more compounds selected from the group described below, or a layer comprising a mixture of one or more metals and one or more of such compounds.

The supports used in this invention may be the same as those used for general recording materials, e.g., plastics, papers, glasses, etc. While the transparency and color of the surface of the support are of no importance, the support should have no chemical influence on the metal layer and, of course, the support must be self supporting.

The metals used in this invention are selected from Mg, Sc, Y, Ti, Zr, Hf, V, Nb, Ta, Cr, Mo, W, Mn, Re, Fe, Co, Ni, Ru, Rh, Pd, Ir, Pt, Cu, Ag, Au, Zn, Cd, Al, Ga, In, Si, Ge, Sn, As, Sb, Bi, Se and Te, and they can be used alone or as a combination of two or more of them.

Of these metals, those which have a low melting point or low reflectance, for example, a melting point of not more than about 700° C., preferably not more than about 400° C., and a reflectance of less than about 60%, preferably less than 30%, are preferred. For example, Mg, Mn, Zn, Al, In, Sn, Bi, Te are preferred as a recording material, and further, in view of no danger of environmental pollution, Mg, Mn, Zn, Al, In and Sn are preferred.

These metals can form, as a single substance or in the form of an alloy, various layers as described hereinafter. In addition, in the case of an alloy, Na, K and Ca may be present therein.

The compounds used in this invention include metal sulfides such as CrS, $Cr_2S$, $Cr_2S_3$, $MoS_2$, MnS, FeS, $FeS_2$, CoS, $Co_2S_3$, NiS, $Ni_2S$, PdS, $Cu_2S$, $Ag_2S$, ZnS, $In_2S_3$, $In_2S_2$, $GeS_x$ (wherein x is a positive integer of 2 to 9, preferably 2 to 4), SnS, $SnS_2$, PbS, $As_2S_3$, $Sb_2S_3$ and $Bi_2S_3$, metal fluorides such as $MgF_2$, $CaF_2$ and $RhF_3$, metal oxides such as MoO, InO, $In_2O$, $In_2O_3$, GeO and PbO, etc. These compounds can be used alone or as a mixture of two or more of them. Particularly desirable compounds are NiS, $In_2O_3$ and $GeS_x$ (wherein x is a positive real number other than 1 as defined), SnS and $In_2S_3$.

When a high-density energy beam such as a laser is used to image-wise expose the recording material of this invention, the metal layer on the support undergoes a thermal deformation and the deformed portions are removed, whereby an optical difference results between the areas where the metal layer has been removed and areas where the metal layer remains. The resultant image can be observed using transmitted light or reflected light.

Considering the above, the optical density of the metal layer or the layer of a mixture of the metal and a compound as defined is required to be at least about 2.0, and in this case, the film thickness required is generally about 300 Å to about 1,500 Å, more preferably about 300 Å to about 1,000 Å, although it depends upon the type of the metal and the state of the formed film, for example. It is to be noted that when the metal is used in multi-layer form, the total thickness of all layers is the same as that when the metal is used in monolayer form, e.g., in a multi-layer embodiment the minimum total thickness of all layers would be about 300 Å.

These metals can be provided on a support by various conventional methods such as vacuum deposition, sputtering, ion-plating, electroplating or electroless plating. For example, the formation of a metal layer of two metals can be performed by vacuum depositing an alloy thereof or vacuum depositing the two metals simultaneously or separately.

The aforesaid compounds used in this invention are used to efficiently absorb the irradiated high-density energy such as laser energy and transmit the heat therefrom into the metal layer to increase the recording sensitivity as compared with the case of using the metal layer alone. Therefore, the compounds having a low reflectance of the image-wise irradiation are preferred, and, in general, those having a melting point higher than the metal used as a recording layer are preferred. Moreover, it is desired that these compounds have good handling properties as a recording material, e.g., they are not hygroscopic and have good stability. These compounds can be provided on a recording material as a compound layer or a layer of a mixture of the metal(s) and the compound(s) by the same methods as can be used for providing the aforesaid metal on the support. A suitable thickness of a layer of the compound is about 10 Å to about 200 Å, particularly, a thickness of 40 Å to 150 Å is preferred.

In those embodiments wherein a mixture of one or more metals and one or more compounds is used, typically such a "mixture" layer will have a thickness of from about 300 to about 1,500 Å, and, most preferably, the metal(s) and the compound(s) have a particle size of from about 5 Å to several hundred Å. In such case, it is preferred that the volume ratio of the compound(s) to the metal(s) be from about 1/5 to about 1/30, most preferably $\frac{1}{8}$ to 1/15. In those instances where such a "mixture" layer is used, a highly preferred structure comprises a support, a layer of the compound thereon, a layer of the metal thereover and, as an uppermost layer, the "mixture" layer.

If more than one "mixture" layer is used in the recording material, the sum total of all the thickness of such "mixture" layer should be within the thickness range earlier set forth.

According to this invention, a recording layer containing a metal(s) and a compound(s) as described provided on a support can be made in various layer constructions.

Referring to the accompanying drawings, various layer constructions will be explained. FIGS. 1 to 5 are sectional views of recording materials of this invention. Like parts are identified with the same reference numerals throughout all of the views.

Figure 2:
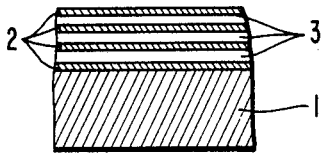
Figure 3:
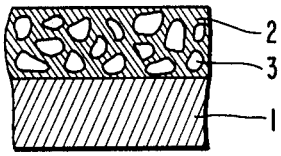
Figure 4:
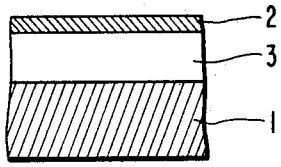
Figure 5:
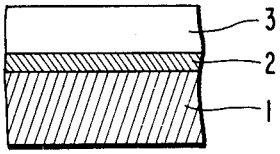

FIG. 1 shows a most typical recording material of this invention in which compound layers 2 are provided on support 1, a metal layer 3 being sandwiched between layers 2. As illustrated in FIG. 2, where like numerals identify like elements, multi-layer construction also be used. Multi-layer construction as in FIG. 2 provides higher transmission density even if the thickness of the recording layer is the same. On the other hand, as illustrated in FIG. 3, a mixture of a metal 3 and a compound 2 can be provided on support 1. Furthermore, as illustrated in FIG. 4, a simple construction where one metal layer 3 and one compound layer are provided on a support 3 can be used. In the case of the construction of FIG. 4, light rays are applied from the side of the recording layer. However, if it is desired to apply light rays from the side of the support, the layer construction illustrated in FIG. 5 can be used in combination with a transparent support.

It is to be noted that since both the metal and the compound of the present invention are melted to thermally deform the same, it is not overly important if the metal is closest to the support or furthest away from the support or if the compound is closest to the support or furthest away from the support. However, when irradiation is applied to a layer of the compound first, the recording material of the present invention has higher sensitivity than in the case of applying irradiation first to the metal layer. This difference in sensitivity is due to the difference in reflectivity of a compound layer as compared to a metal layer.

According to this invention, thermally sensitive recording materials of high recording sensitivity can be obtained especially as compared with recording materials comprising only a metallic thin film. Further, thermally sensitive recording materials providing good image quality can be obtained. Moreover thermally sensitive recording materials having the above advantages can be prepared from the materials which are harmless to humans.

The following examples further illustrates this invention.

EXAMPLE 1

Metal (In) and various compounds were vacuum deposited on a polyethylene terephthalate support 100μ thick at $5\times10^{-5}$ Torr to prepare recording materials having the composition and layer construction shown in Table 1. The metal (In) layer used herein and a thickness of 500 A in the case of a monolayer of the metal, and with a two metal layer construction (four total layers), two metal layers each having a thickness of 250 A were formed. The compound layers were provided between the metal layers and on the surface of the support and each had a thickness of 75 Å. On the recording materials thus prepared, an argon laser beam (wavelength of 4880 Å) of a 400 mW output which had been condensed to a beam radius of 34μ was scanned at 19 M/sec. The strength of the laser beam shows Gauss distribution, and the beam radius denotes the radius which takes the value $1/e^2$, i.e., 0.135 times, as against the peak strength on an optical axis. By changing the strength of the beam, the minimum energy amount required for recording on the above recording material was determined, and the ASA corresponding sensitivity of the recording material was calculated from the obtained value. The sensitivity is shown in Table 1 for each of the recording materials.

As is apparent from the results shown in Table 1, the recording materials containing the aforesaid compounds have higher sensitivity by a factor of two or more as compared with the case of using a monolayer of the metal (In). In addition to the compounds shown in Table 1, recording materials containing NiS, $Ni_2S$, CrS, $Cr_2S$, $MoS_2$, FeS, $FeS_2$, CoS, PdS, $Ag_2S$, $RhF_3$, GeO, or the like, also have an ASA corresponding sensitivity of about $1.9\times10^{-5}$ to $1.5\times10^{-5}$, which is higher than that of a recording material having a monolayer of the metal (In). The same effect is obtained in the case of using other metals.

TABLE 1

| Sample No. | Metal | Compound | Number of Layers | ASA Corresponding Sensitivity |
|---|---|---|---|---|
| 1 | In* | — | 1 | $9.2\times10^{-6}$ |
| 2 | In | $GeS_2$ | 4 | $2.5\times10^{-5}$ |
| 3 | In | MnS | 4 | $2.3\times10^{-5}$ |
| 4 | In | $In_2S_3$ | 4 | $2.3\times10^{-5}$ |
| 5 | In | SnS | 4 | $2.3\times10^{-5}$ |
| 6 | In | $SnS_2$ | 4 | $2.1\times10^{-5}$ |
| 7 | In | ZnS | 4 | $2.1\times10^{-5}$ |

*Comparison

In this example, the deposition rate of the metals was 600–1,000 Å/15 seconds and the deposition rate of the compounds was 100–200 Å/15 seconds using a tungsten boat; the following evaporation temperatures were used:

| | |
|---|---|
| In | about 1,000° C.–about 1,300° C. |
| $GeS_2$ | about 500° C. |
| SnS | about 600° C. |
| $In_2S_3$ | about 600° C. |
| MnS | about 1,700° C. |
| $SnS_2$ | about 600° C. |
| ZnS | about 1,200° C. |

EXAMPLE 2

Various metals and the compound (MnS) were provided on the type of same support as was used in Example 1 to form layers having the same film thicknesses as in Example 1. In the same manner as in Example 1, the laser beam was scanned and recording sensitivity determined. The results obtained are shown in Table 2.

As is apparent from the results shown in Table 2, the recording materials containing the compound (MnS) had a higher sensitivity by a factor of two as compared with the case of using a monolayer of the metal. In addition to the metals shown in Table 2, when Al, Ti, Cr, Fe, Co, Rh, Ni, Pd, Pt, Cu, Ag, Au, Ge, Zn, Mn, Bi, or the like were used together with the compound (MnS), equally higher recording sensitivities were obtained as compared with the case of using a monolayer of the metal.

TABLE 2

| Sample No. | Metal | Compound | Number of Layers | ASA Corresponding Sensitivity |
|---|---|---|---|---|
| 1 | Mg | — | 1 | * |
| 2 | Mg | MnS | 4 | $2.0\times10^{-5}$ |
| 3 | Sn | — | 1 | $1.0\times10^{-5}$ |
| 4 | Sn | MnS | 4 | $2.2\times10^{-5}$ |
| 5 | Ca | — | 1 | $9.0\times10^{-6}$ |
| 6 | Ca | MnS | 4 | $2.1\times10^{-5}$ |

*Comparison Sample; recording could not be performed.

When the trace of the recording on the recording material of this invention in Examples 1 and 2 were absorbed at 400× magnification, it was seen that the metal was completely removed at the image line portions. However, with a recording material having a monolayer of the metal, small grains of the metal were present in the image line portions or the image line portions were notched at both sides, and, thus were uneven. Therefore, it is obvious that recording on the recording material of this invention gives excellent image quality.

As will be apparent to one skilled in the art, while a laser was used in the above examples, other equivalent high intensity energy sources can be used, for example, electron beams, ionic discharge, or the like. Excellent results can be obtained if the energy source has an intensity of about $10^3$ watt/cm$^2$ or higher.

While the invention has been described in detail and with reference to specific embodiments thereof, it will be apparent to one skilled in the art that various changes and modifications can be made therein without departing from the spirit and scope thereof.

What is claimed is:

1. A material for recording a high temperature energy source scanned imagewise by evaporating or thermally deforming the scanned portions by melting of at least one recording layer thereof by the heat energy of said high temperature energy source, which comprises a support and at least one recording layer, said at least one recording layer containing at least one distinct metal layer comprising at least one metal selected from the group consisting of Sn, Bi, In, Zn, Al and Cu and said recording layer also comprising at least one distinct compound layer comprising at least one compound selected from the group consisting of CrS, $Cr_2S$, $Cr_2S_3$, $MoS_2$, MnS, FeS, $FeS_2$, CoS, $Co_2S_3$, NiS, $Ni_2S$, PdS, $Cu_2S$, $Ag_2S$, ZnS, $In_2S_3$, $In_2S_2$, $GeS_X$, wherein x is a positive integer of 2 to 9, SnS, $SnS_2$, PbS, $As_2S_3$, $Sb_2S_3$, $Bi_2S_3$, $MgF_2$, $CaF_2$, $RhF_3$, MoO, $In_2O$, $In_2O_3$, GeO, and PbO, and at least one layer which contains one or more of said metals in combination with one or more of said compounds and wherein the total thickness of all metal layers present is from about 300 to about 1,500 Å, the total thickness of all compound layers present is from about 10 to about 200 Å, and the optical density of the at least one distinct metal layer is at least about 2.0.

2. The recording material of claim 1 wherein said at least one distinct compound layer is on said support, said at least one distinct metal layer is over said at least one distinct compound layer and said at least one layer containing one or more of said metals in combination with one or more of said compounds is the uppermost layer.

3. The recording material of claim 1 wherein said at least one compound is selected from the group consisting of NiS, $In_2O_3$, $GeS_x$, wherein x is a positive integer of 2 to about 9, SnS and $In_2S_3$.

4. The recording material of claim 1 wherein the total thickness of all metal layers present is from about 300 A to about 1,000 Å.

5. In a process for recording information on a recording material by imagewise scanning the recordng material with a high temperature energy source to evaporate or thermally deform by melting the scanned portions of a recording layer of the recording material by the heat energy of the high temperature energy source thereby removing said scanned portions of said recording layer, the improvement wherein the recording material comprises a support and at least one recording layer, said at least one recording layer containing at least one distinct metal layer comprising at least one metal selected from the group consisting of Sn, Bi, In, Zn, Al and Cu and said recording layer also comprising at least one distinct compound layer comprising at least one compound selected from the group consisting of CrS, $Cr_2S$, $Cr_2S_3$, $MoS_2$, MnS, FeS, $FeS_2$, CoS, $Co_2S_3$, NiS, $Ni_2S$, PdS, $Cu_2S$, $Ag_2S$, ZnS, $In_2S_3$, $In_2S_2$, $GeS_x$, wherein x is a positive integer of 2 to 9, SnS, $SnS_2$, PbS, $As_2S_3$, $Sb_2S_3$, $Bi_2S_3$, $MgF_2$, $CaF_2$, $RhF_3$, MoO, InO, $In_2O$, $In_2O_3$, GeO, and PbO, and wherein the total thickness of all metal layers present is from to 300 to 1500 A, the total thickness of all compound layers present is from about 10 to about 200 A, and the optical density of the at least one distinct metal layer is at least about 2.0.

6. The process of claim 5 wherein the energy source has an intensity of about $10^3$ watt/$cm^2$ or higher.

7. The process of claim 6 wherein the recording material is scanned with a laser beam.

8. The process of claim 5 wherein said at least one distinct compound layer is subjected to the high temperature energy source prior to said at least one distinct metal layer.

9. The process of claim 5 wherein there is also present on said support at least one layer which contains one or more of said metals in combination with one or more of said compounds.

10. The process of claim 9 wherein said at least one distinct compound layer is on said support, said at least one distinct metal layer is over said at least one distinct compound layer and said at least one layer containing one or more of said metals in combination with one or more of said compounds is the uppermost layer.

11. The recording material of claim 9, wherein the volume ratio of said one or more compounds to said one or more metals is about 1/5 to about 1/30 in said one layer.

* * * * *